US006484921B2

(12) United States Patent
Hakozaki et al.

(10) Patent No.: US 6,484,921 B2
(45) Date of Patent: Nov. 26, 2002

(54) STAPLER

(75) Inventors: Katsuya Hakozaki, Tokyo (JP); Kazuo Higuchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 106 days.

(21) Appl. No.: 09/817,553

(22) Filed: Mar. 26, 2001

(65) Prior Publication Data

US 2001/0023887 A1 Sep. 27, 2001

(30) Foreign Application Priority Data

Mar. 24, 2000 (JP) ..... 2000-084790

(51) Int. Cl.[7] ..... B27F 7/36
(52) U.S. Cl. ..... 227/2; 227/5; 227/6; 227/155
(58) Field of Search ..... 227/110, 111, 227/155, 2, 4, 3, 7, 5, 154, 156, 6, 131

(56) References Cited

U.S. PATENT DOCUMENTS 2,770,805 A 11/1956 Elzer et al.
3,055,009 A * 9/1962 March ..... 227/3
3,994,427 A * 11/1976 Ganatsiou ..... 227/7
4,386,725 A * 6/1983 Chambers ..... 227/110
4,676,421 A * 6/1987 Swanstrom ..... 227/4
4,940,177 A 7/1990 Jimena
5,782,196 A * 7/1998 Cunningham et al. ..... 227/9
5,803,337 A * 9/1998 Fukai et al. ..... 227/131
6,062,454 A * 5/2000 Morishige et al. ..... 227/2

FOREIGN PATENT DOCUMENTS

EP 0 779 134 A1 6/1997 ..... B27F/7/19
WO WO99/42253 8/1999 ..... B25C/1/00

* cited by examiner

*Primary Examiner*—Scott A. Smith
(74) *Attorney, Agent, or Firm*—Chapman and Cutler

(57) ABSTRACT

A motor driven stapler in which there are no fears of cutting off and need for loosed part of the lead wires of photo sensor for detection of sheets to be bundled, is provided. The stapler comprises a driving out portion from which a stapler is driven out; a table 42 which forwardly and backwardly reciprocates; and a clincher which is disposed on the table 42 so as to put and hold a pile of sheets to be bundled between itself and the driving out portion when the table 42 forwardly moves and at the same time a stapler is driven out from the driving out portion against the pile of sheets, and to clinch the front end portions of the staple which penetrate through the pile of sheets, wherein a photo sensor 50 is disposed in the other side of table 42 opposite to the driving out portion; and one or more through holes 48 are arranged in the table 42 in order to guide the emitted light beam from a light emission diode 51 of the photo sensor 50 to the pile of sheets and to guide the reflected light beam from a surface of the pile of sheets to a light receiving diode 52 of said photo sensor 50.

5 Claims, 7 Drawing Sheets

STAPLER

BACKGROUND OF THE INVENTION

1. Field of the Invention

The present invention relates to a stapler which is disposed to a copying machine and so on.

2. Description of the Prior Art

Heretofore a motor driven stapler is well known which comprises, a driving out portion from which a stapler is driven out, a table which forwardly and backwardly reciprocates and a clincher which is disposed on the table. In the motor driven stapler of this kind, a pile of sheets to be bundled is put and held between the driving out portion and the table when the table forwardly moves, and at the same time a staple is driven out from the driving out portion against the put and held pile of sheets, then the front end portions which penetrate through the pile of sheets are clinched by the clincher.

For the motor driven stapler of this kind, a photo sensor of reflecting type is disposed for detection if the pile of sheets is put on the table.

The photo sensor gives an order for the table to forwardly move and to drive out the stapler from the driving out portion by the driver when it detects the pile of sheets, and prevents useless driving out.

However, because the photo sensor is disposed in the table and a lead wire for the photo sensor is compelled extending and loosening in every reciprocal movement of the table and the lead wire must be given a loosed portion. Due to this fact, a problem arises that the lead wire is torn when it touches with a corner of the stapler body unless it is not covered with protector to protect the loosening portion, and it makes the regarding portion bombastic.

SUMMARY OF THE INVENTION

The object of the invention is to provide a stapler in which there are no fears for a cutting of the lead wire or need for loosed part of the lead wire of photo sensor for detection of sheets to be bundled. To attain this object according to one aspect of the present invention, a stapler comprising a driving out portion from which a stapler is driven out; a table which forwardly and backwardly reciprocates; and a clincher which is disposed on said table so as to put and hold a pile of sheets to be bundled between itself and said driving out portion when said table forwardly moves and at the same time a stapler is driven out from the driving out portion against the pile of sheets, and to clinch the front end portions of the staple which penetrate through the pile of sheets, said stapler characterized in that a photo sensor is disposed in the other side of said table to said driving out portion; and one or more through holes are arranged in said table in order to guide the emitted light beam from a light emission portion of said photo sensor to the pile of sheets and to guide the reflected light beam from a surface of the pile of sheets to a light receiving portion of said photo sensor, is provided.

DETAILED DESCRIPTION OF THE EMBODIMENT

Hereafter an embodiment of the stapler according to the present invention will be explained with reference to the drawings.

Figure 1:
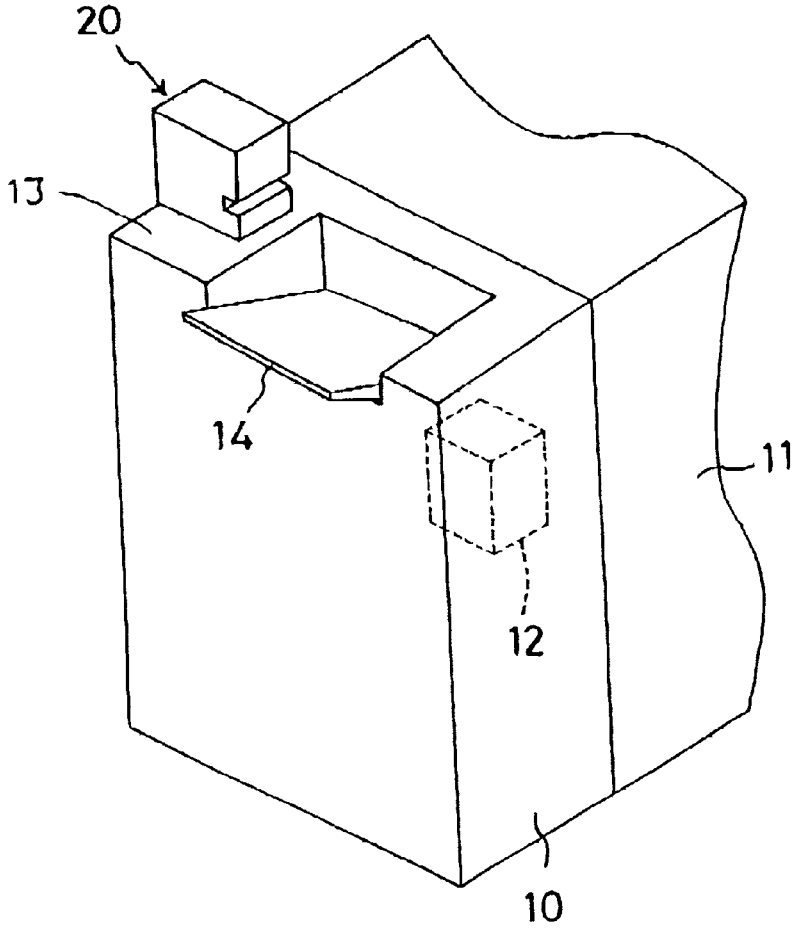
FIG. 1 is an exemplary perspective view of stapler according to the present invention which is disposed to a post processing apparatus of copying machine.

In FIG. 1 reference numeral 10 denotes a post processing apparatus disposed to a body of copying machine 11. In the post processing apparatus 10, an upside down type stapler 12 is disposed for binding a pile of printed sheets which is discharged from the copying machine body 11 with the surface of copied side down. On the top surface of post processing apparatus 10, another upside down type stapler 20 is also provided. A stapler body 40 of the stapler 20 (Refer to FIG. 2 to FIG. 4) has quite the same structure to that of the stapler body of stapler 12 (not shown) because the same kind of stapler is employed.

Figure 2:
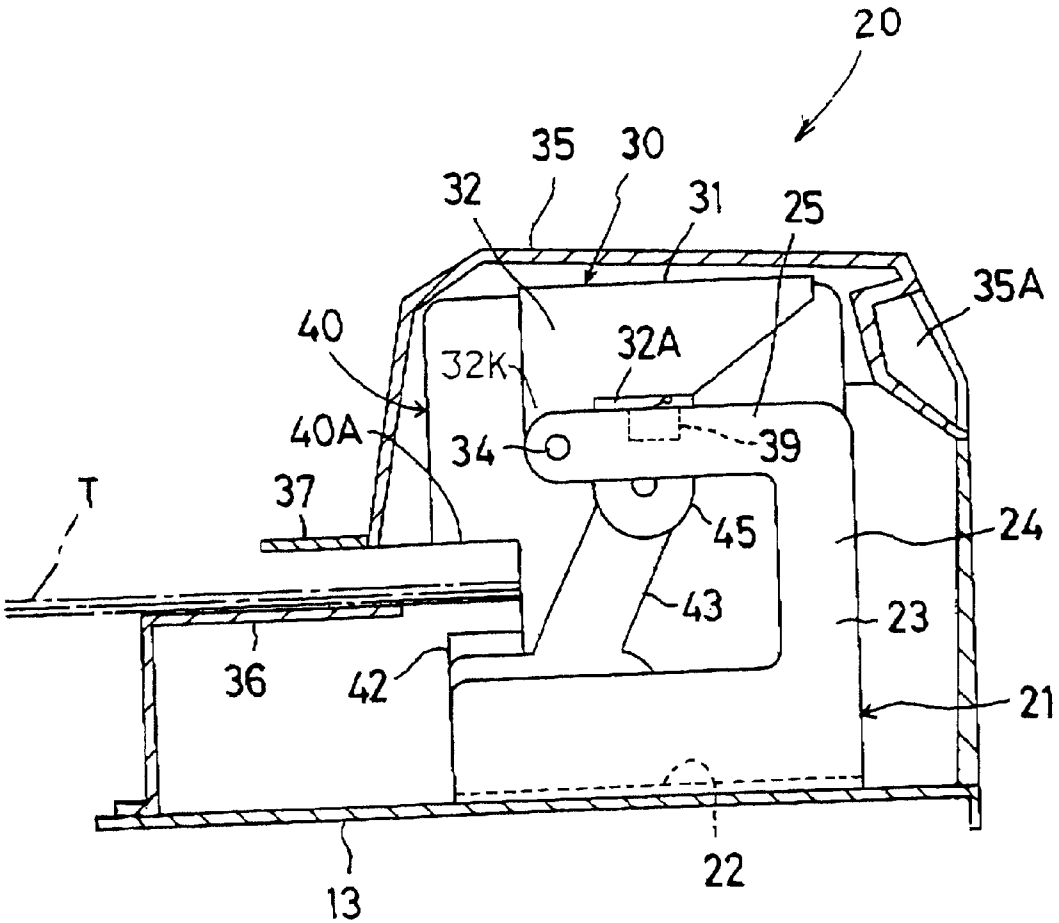
FIG. 2 is an explanatory cross sectional side view to show the relation between stapler body and base plate thereof which are disposed on the top portion of a post processing apparatus.
Figure 3:
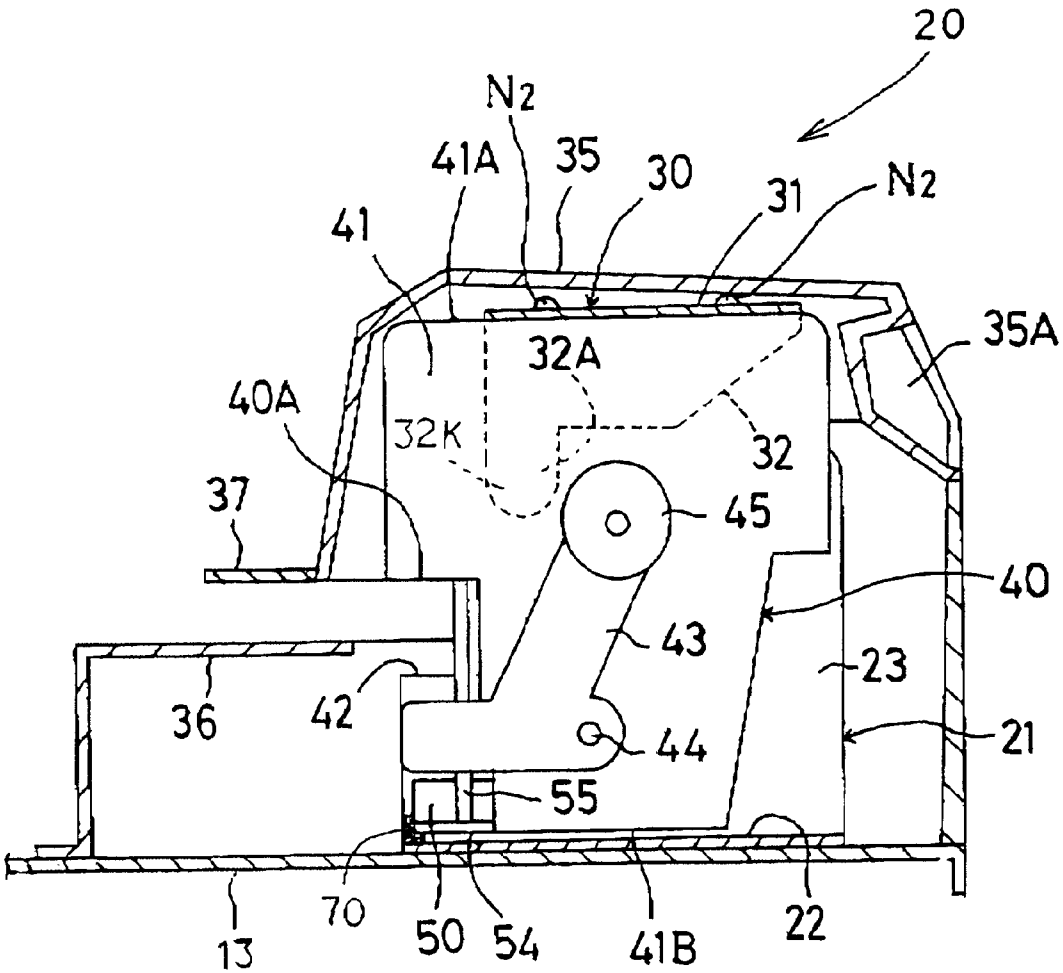
FIG. 3 is an explanatory cross sectional side view to show the stapler body of FIG. 2.
Figure 4:
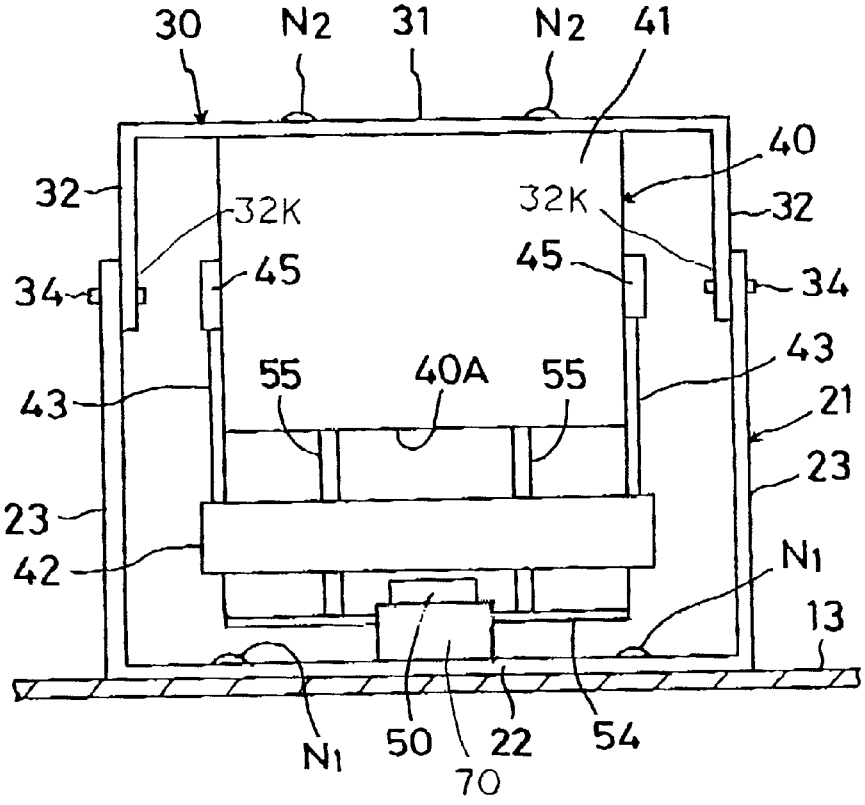
FIG. 4 is a front view to show a stapler body.

As shown in FIG. 2 to FIG. 4, the stapler 20 comprises a base plate 21 which is fixed on a top board 13 of the post processing apparatus 10, a bracket 30 which is rotatably attached on the base plate 21, a stapler body 40 which is fixed on the bracket 30 and a cartridge 60 (Refer to FIG. 7) which is removably loaded to the stapler body 40.

The base plate 21 has a base board portion 22 which is fixed by screws N1 on the top board 13 of post processing apparatus 10, and plates 23, 23 are formed which are standing from both ends of the base board portion 22. The plate 23 is formed to have an U-shaped cross section and having support pillar board portion 24 and arm board portion 25 which is extending from upper portion of the support pillar board portion 24 to frontward (leftward in FIG. 2).

The bracket 30 has a flat board portion 31 which is fixed by screws N2 on bottom wall portion 41A of a case 41 of the stapler body 40, and attachment piece 32, 32 are formed to hand over from both ends of the flat board portion 31. Respective lower portions 32K of attachment pieces 32 are supported by a shaft 34 at the front end portion of arm board portion 25 of the base plate 21, and they are rotatable around the shaft 34.

In the above described structure, the stapler body 40 is attached to the base plate 21 in order to turn around the shaft 34, and to be in a posture of downside up.

The stapler body 40 is arranged to be fixed by L-shaped a stopper (fixing means) 70 which is made of magnet on the position shown in FIG. 2 to FIG. 4. The stopper 70 is attached to the base board portion 22 of base plate 21, and magnetically attracts the stapler body 40 facing to contact together with a top portion of support board 54, which is explained later and to fix the stapler body 40. When the stapler body 40 is fixed by the stopper 70 on the position shown in FIG. 2 to FIG. 4, a micro switch (detecting means) 39 is arranged to detect the presence and fixing of the stapler body. The micro switch 39 is disposed at the inside portion of arm board portion 25 of the base plate 21, it is arranged to be turned on by a concave portion 32A of the attachment piece 32 of bracket 30, by this turning on the presence and fixing of stapler body 40 is detected.

An upper cover 35 is attached to the bracket 30, a concave portion 35A is formed at a back portion of the upper cover 35 and for manual operation fingers are put on at the concave portion. The reference numeral 36 denotes a support plate on which a pile of sheets T to be bundled is put, the reference numeral 37 denotes a cover which is attached at upward of the support plate 36, and is fixed on the support plate 36 through a support portion which is not shown.

In the stapler body 40 there are provided a driving mechanism (not shown) which drives sheet of staples (not shown) stored and piled in a cartridge 60 to a driving out portion 40A, a driver (not shown) which forwardly and backwardly reciprocates to drive out the staple from the driving out portion 40A, and a table 42 having a clincher (not shown) which clinches the front end portions of driven out staple.

According to the structure that the stapler body 40 is attached to the base plate 21 in downside up position, the cartridge 60 is disposed over the table 42 and the table 42 is disposed under the cartridge 60, then the staple is driven out from upper side to lower side of the table 42.

Table 42 is arranged to be reciprocated upwardly and downwardly by rotational movement of a link member 43 around a shaft 44. A roller 45 is disposed in upper portion of the link member 43, and a cam which is not shown in the figure, is contacting with the roller 45, then the link member 43 is arranged to rotate around the shaft 44 by the rotational movement of the cam.

Figure 5:
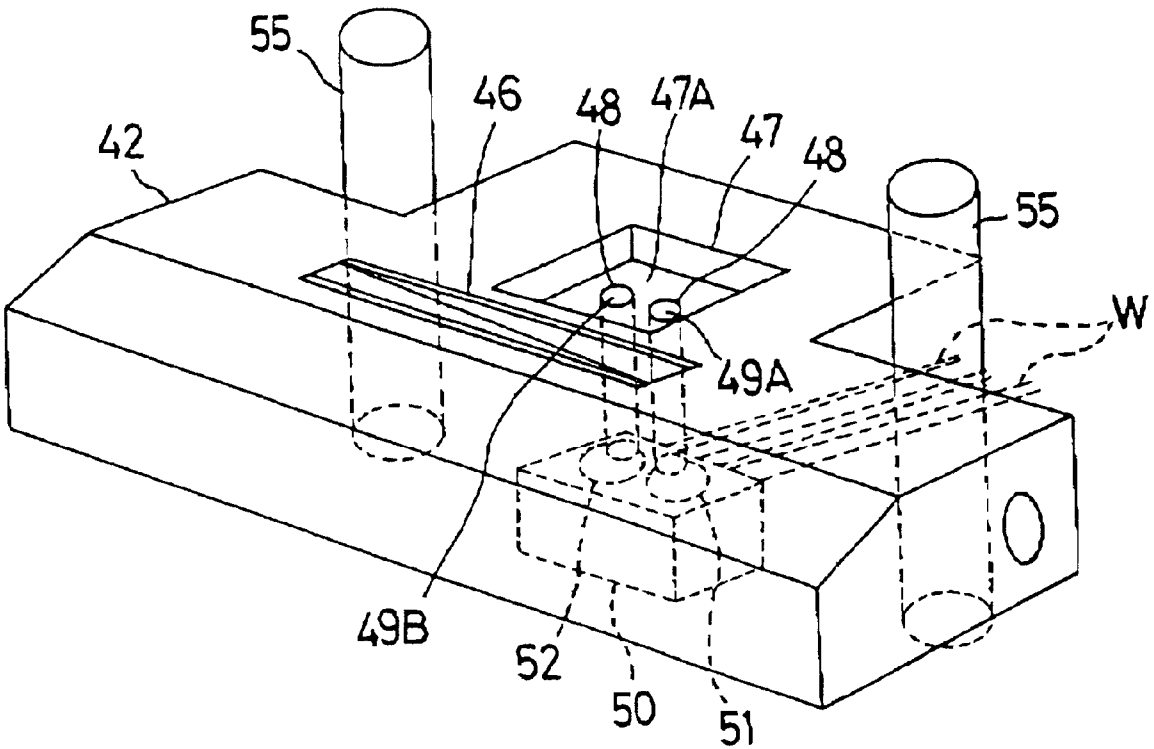
FIG. 5 is a perspective view to show a table.

An opening 46 is formed on the upper surface of table 42 as shown in FIG. 5, into which legs of staple are inserted after penetrating the pile of sheets T to be bundled, and the clincher (not shown) is disposed under the opening 46, by which the legs of staple are clinched. A concave portion 47 is formed at the back of opening 46 on the upper surface of table 42 and two through holes 48, 48 are formed in bottom portion 47A of the concave portion 47, and optical fibers 49A, 49B are disposed in the through holes 48, 48.

A photo sensor 50 is disposed at lower part of the table 42 for detecting if a pile of sheets T is put on the table 42 or not. This photo sensor 50 consists of light emission diode (light emission portion) 51 and light receiving diode (light receiving portion ) 52, the light emission diode 51 is arranged to confront with a lower end of the optical fiber 49A, and the light receiving diode 52 is arranged to confront with a lower end of the optical fiber 49B. The photo sensor 50 is attached to a support board 54 which is formed so as to project forwardly from a front end of the top board 41B of case 41 of the stapler body 40.

Figure 6:
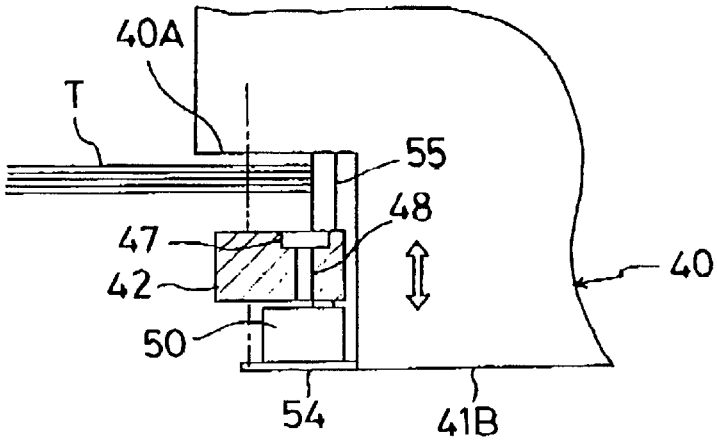
FIG. 6(A) is a side view to shown the positional relation among a pile of sheet, table and photo sensor.
FIG. 6(B) is a plan view to show the positional relation among a pile of sheets, table and a photo sensor.
Figure 6:
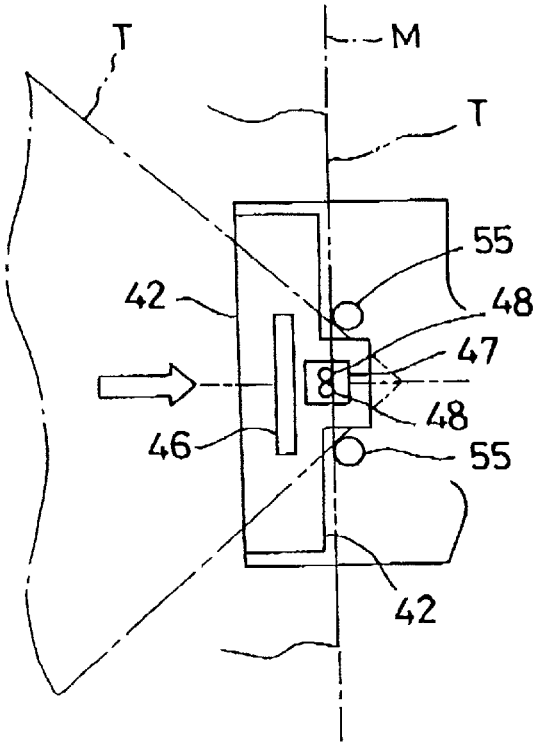

Guide pins 55, 55 are arranged to stand and guide the pile of sheets T as shown in FIG. 6, and the guide pins 55, 55 are located in the positions that the front ends of guide pins are contacting from outside with an extending line of a common tangential line of back ends of the through hole 48 and 48 so that a distance between the guide pins is much larger than that of between the through holes. They are arranged when a pile of sheets T to be bundled is inserted and contacts with both guide pins as shown by the dotted broken line or the double dotted broken line, so that he top surfaces of optical fibers 49A and 49B of through holes 48 and 49 are covered with the sheets and confronts with the bottom surface of the pile of sheets T.

Hereafter the operation of stapler with above described structure will be given.

A copied paper which is pressed by the copying machine 11 is discharged to the post processing apparatus 10 with the copied surface down. In case when all the copied papers are bundled, the pile of sheets is bundled by stapler 12 as usual in the prior art technique and it goes to be discharged at the discharging tray 14.

In case when all the copied papers are not bundled, the copied paper is discharged at the discharging tray 14 with the copied surface down.

In case when only desired some of the copied paper among all are to be bundled, the desired some of copied papers are put on the support plate 36 with their copied surface up and inserted so as to contact with both guide pins 55 and 55 as shown in FIG. 6(B) by the dotted broken line or the double dotted broken line.

On the other hand, a light emission diode 51 of the photo sensor 50 is lighted and the light beam is projected upward through the optical fiber 49A in the table 42 from the top end of optical fiber 49A. The projected light beam from the top end of optical fiber 49A is reflected by outer surface of the pile of sheets T and enters back to the optical fiber 49B in the table 42. The entered light to the optical fiber 49B is projected from the bottom end of optical fiber 49B and it is received by a light receiving diode 52 of the photo sensor 50.

When the light receiving diode 52 receives the light, the micro switch is turned on, and a control circuit which is not shown in the figure, judges that a pile of sheets T to be bundled is surely put on the support plate 36, then it makes an order to start a motor (now shown) driving. The table 52 goes up by this driving of motor in order for pile of sheets T to be put and held between the table 42 and the driving out portion 40A. Then a staple is driven out from the driving out portion 40A and the legs of staple penetrate through the pile of sheets T and the legs of staple are clinched by the clincher arranged on the table 43, thus the pile of sheets is bundled by the stapler. The table 42 goes down and returns to its home position after whole process has been completed.

Figure 7:
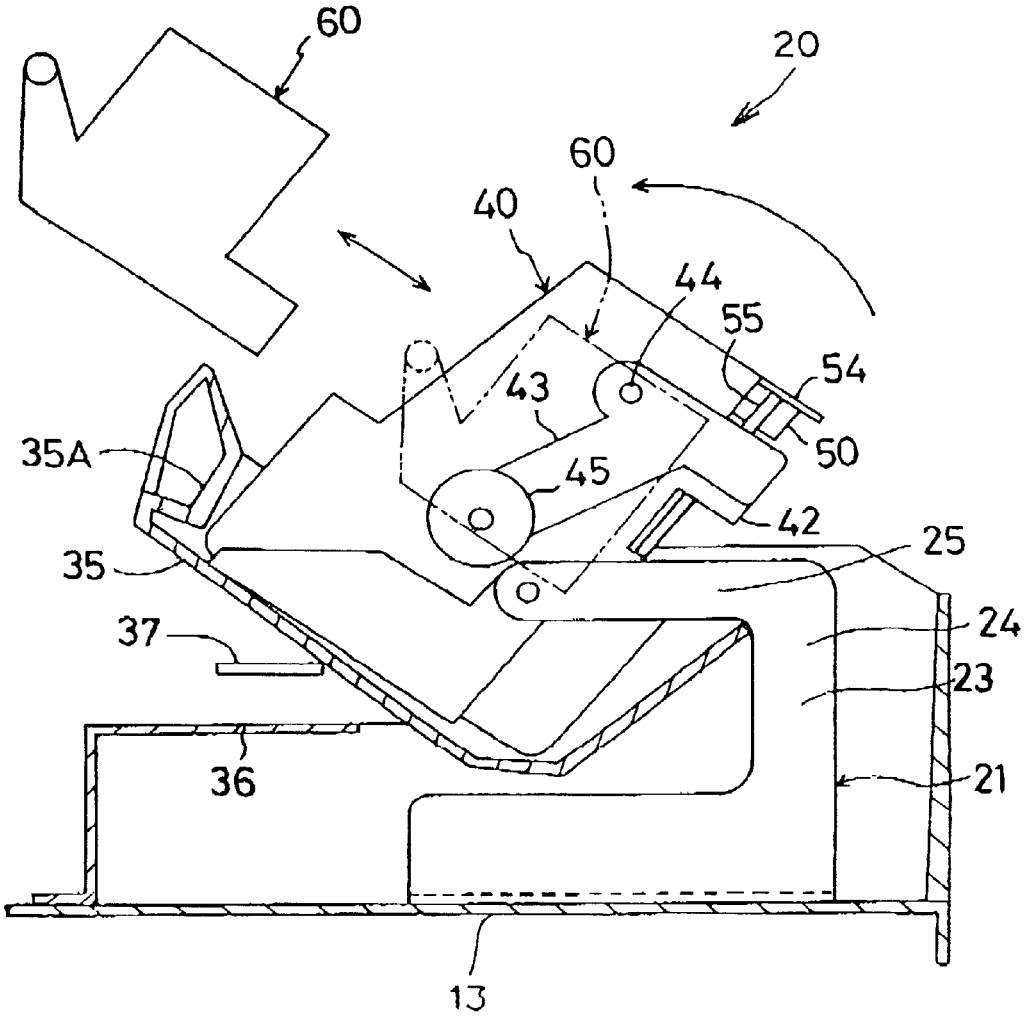
FIG. 7 is an explanatory side view of stapler body which is turned downside up.

When the cartridge 60 is exchanged, the support board 54 of stapler body 40 is detached from the stopper 70 and the stapler body 40 is turned around in counter clockwise with enforcing stapler body 40 and the upper cover 35 to turn counter clockwise by handling operation at the convex portion 35A of upper cover 35 as shown in FIG. 7. The stapler body 40 takes a posture upside down. By this motion the stapler body 40 returns to be normal position.

When the stapler body 40 is turned around as shown in FIG. 7, it is fixed at the position by a stopper which is not shown in the figure. Then the cartridge 60 is pulled slantwise out to upward and new cartridge 60 is inserted into the stapler body 40 in order to be loaded.

As described above, the exchange of cartridge 60 is easily attained by inserting slantwise the cartridge 60 to downward into stapler body 40.

When the stapler 40 is in a posture of turning around, because the micro switch 39 is turned to off, it is prevented that the stapler body 40 is driven in error.

After the loading of cartridge 60 is completed, the stapler body 40 is turned again reverse to the above, in clockwise with the upper cover 35 in order to be in the position shown in FIG. 2 to FIG. 4.

As above described even by the upside down positioned type stapler 20 the pile of sheets T can be bundled with its copied surface up, and the loading of cartridge 60 can be easily achieved by turning the stapler body 40. Further, because the same upside down positioned type model of stapler is used for both of the stapler body 40 and stapler body 12, reduction of material cost is achieved, and the same type of stapler and the same way to bundle is used because the same type of cartridge is employed, the appearance of pile of sheets bundled by stapler 12 and by stapler 20 seem to be same and it gives a good feeling.

Moreover, because the photo sensor 50 is attached to the support board 54 of top board 41B of the stapler 40, it is prevented that the lead wire W is extended and loosened together with an upward and downward movement of the table 42. By this structure a cut off problem of the lead wire W with friction does not occur. And there is no need to make lead wire W longer for loosening portion.

Further, because the light is emitted though the optical fiber 49A in the table 42 to the pile of sheets T, the light which is emitted from the light emission diode 51 of photo sensor 50, can be projected on the surface of pile of sheets T without being weakened. As the structure is arranged to receive the reflected light from pile of sheets T through the optical fiber 49B in the table 42 by the light receiving diode 52 of photo sensor 50, the reflected light from the pile of sheets T can be received without being weakened. By this fact the detection of pile of sheets T can be surely achieved even when the distance between the photo sensor 50 and the pile of sheets T is much long.

In the above described embodiment two optical fiber 49A and 49B are disposed in the table 42, however, one optical fiber can be employed when the diameter of optical fiber is large. Further, the optical fiber 49A and 49B can be omitted when the power of light from the light emission diode 51 is large and at the same time the reflectivity of pile of sheets T for light is high.

What is claimed is:

1. A stapler comprising:

a driving out portion from which a staple is driven out;

a table which forwardly and backwardly reciprocates; and a clincher which is disposed on said table so as to put and hold a pile of sheets to be bundled between itself and said driving out portion when said table forwardly moves and at the same time a staple is driven out from the driving out portion against the pile of sheets, and to clinch the front end portions of the staple which penetrate through the pile of sheets, said stapler characterized in that, a photo sensor is disposed in the other side of said table opposite to said driving out portion; and one or more through holes are arranged in said table in order to guide the emitted light beam from a light emission portion of said photo sensor to the pile of sheets and to guide the reflected light beam from a surface of the pile of sheets to a light receiving portion of said photo sensor.

2. A stapler according to claim 1, characterized in that one or more optical fibers are disposed in said one or more through holes.

3. A stapler according to claim 1, characterized in that a concave portion is formed on a surface of support plate of said table on which the pile of sheets to be bundled is put, and said one or more through holes are disposed at a bottom portion of said concave portion.

4. A stapler according to claim 3, characterized in that said through holes are consisted by respective two holes for light emission and light receiving.

5. A stapler according to claim 4 characterized in that optical fibers are disposed in said two through holes.

* * * * *